US011634877B2

(12) United States Patent
Xu et al.

(10) Patent No.: US 11,634,877 B2
(45) Date of Patent: Apr. 25, 2023

(54) METHOD FOR REMOVAL OF TEMPORARY SUPPORT SYSTEM FOR ROAD BRIDGE PRE-FABRICATED SMALL BOX GIRDER-TYPE CONCEALED BENT CAP, AND EQUIPMENT THEREFOR

(71) Applicant: Ningbo Municipal Engineering Construction Group Co., Ltd., Zhejiang (CN)

(72) Inventors: Shengliang Xu, Zhejiang (CN); Jufeng Chen, Zhejiang (CN)

(73) Assignee: Ningbo Municipal Engineering Construction Group Co., Ltd., Zhejiang (CN)

( * ) Notice: Subject to any disclaimer, the term of this patent is extended or adjusted under 35 U.S.C. 154(b) by 0 days.

(21) Appl. No.: 17/630,902

(22) PCT Filed: Dec. 18, 2020

(86) PCT No.: PCT/CN2020/137474

§ 371 (c)(1),
(2) Date: Jan. 27, 2022

(87) PCT Pub. No.: WO2021/078310

PCT Pub. Date: Apr. 29, 2021

(65) Prior Publication Data

US 2022/0333320 A1 Oct. 20, 2022

(30) Foreign Application Priority Data

Oct. 21, 2019 (CN) ..... 201911002531.3

(51) Int. Cl.
*E01D 22/00* (2006.01)
*E01D 21/00* (2006.01)

(52) U.S. Cl.
CPC ..... *E01D 22/00* (2013.01); *E01D 21/00* (2013.01)

(58) Field of Classification Search
CPC ..... E01D 21/00; E01D 22/00
(Continued)

(56) References Cited

U.S. PATENT DOCUMENTS 2,927,396 A * 3/1960 Hall, Jr. ..... A63H 33/044 104/275
3,385,455 A * 5/1968 Dal Pont ..... B66C 23/00 212/343

(Continued)

FOREIGN PATENT DOCUMENTS

CN 101538831 9/2009
CN 103669902 3/2014

(Continued)

OTHER PUBLICATIONS

"International Search Report (Form PCT/ISA/210) of PCT/CN2020/137474," dated Mar. 17, 2021, with English translation thereof, pp. 1-6.

(Continued)

*Primary Examiner* — Raymond W Addie
(74) *Attorney, Agent, or Firm* — JCIP Global Inc.

(57) ABSTRACT

A method for removal of a temporary support system for a road bridge pre-fabricated small box girder-type concealed bent cap, and equipment therefor. The removal method comprises the following steps: removing cantilever beams; removing lateral pier support systems and loading same onto a truck; removing outer-side main beam sections connected to lateral pier support systems and loading same onto a truck; removing, horizontally displacing, and lowering a main beam middle section connected to the main pier support system; hoisting, lowering, and laying flat a main (Continued)

truss system, and loading same onto a truck; and removing a main pier vertical support system and a pad beam.

8 Claims, 10 Drawing Sheets

(58) Field of Classification Search
USPC ..... 14/77.1
See application file for complete search history.

(56) References Cited

U.S. PATENT DOCUMENTS 3,571,835 A * 3/1971 Buechler ..... E01D 21/00 264/33
4,042,991 A * 8/1977 Macy ..... E04B 5/14 52/645
4,497,153 A * 2/1985 Muller ..... E01D 21/00 52/745.2
4,927,537 A * 5/1990 Meurer ..... B01D 21/04 74/89.22
5,896,609 A * 4/1999 Lin ..... E01D 21/105 14/18
6,721,985 B2 * 4/2004 McCrary ..... B60L 3/0046 212/315
7,478,450 B2 * 1/2009 Fong ..... E01D 21/00 14/23
7,546,656 B2 * 6/2009 Kim ..... E01D 2/00 14/77.3
8,136,191 B2 * 3/2012 Jorkama-Lopez .... E01D 19/106 14/78
8,671,490 B1 * 3/2014 Carney ..... B66C 13/04 14/2.4
8,869,336 B2 * 10/2014 Meyer ..... E01D 21/10 414/10
9,021,644 B2 * 5/2015 Kawabata ..... E01D 11/04 14/22
10,655,287 B2 * 5/2020 Cousin ..... E01D 19/04
11,473,253 B2 * 10/2022 Wang ..... E01D 19/12
11,479,929 B2 * 10/2022 Huber ..... E01D 19/02
2010/0064454 A1 * 3/2010 Grace ..... E01D 2/02 14/73

FOREIGN PATENT DOCUMENTS

CN 103711078 4/2014
CN 208293447 12/2018
CN 110055908 7/2019
CN 110747761 2/2020
CN 212052327 12/2020
JP 2014190107 10/2014
JP 2019090221 6/2019

OTHER PUBLICATIONS

"Written Opinion of the International Searching Authority (Form PCT/ISA/237) of PCT/CN2020/137474," dated Mar. 17, 2021, with English translation thereof, pp. 1-10.

* cited by examiner

METHOD FOR REMOVAL OF TEMPORARY SUPPORT SYSTEM FOR ROAD BRIDGE PRE-FABRICATED SMALL BOX GIRDER-TYPE CONCEALED BENT CAP, AND EQUIPMENT THEREFOR

CROSS-REFERENCE TO RELATED APPLICATION

This application is a 371 of international application of PCT application serial no. PCT/CN2020/137474, filed on Dec. 18, 2020, which claims the priority benefit of China application no. 201911002531.3, filed on Oct. 21, 2019. The entirety of each of the above mentioned patent applications is hereby incorporated by reference herein and made a part of this specification.

TECHNICAL FIELD

The present invention relates to a removal method, and in particular, to a method for removal of a temporary support system for a road bridge pre-fabricated small box girder-type concealed bent cap.

The present invention further relates to removal equipment applicable to the foregoing removal method.

DESCRIPTION OF RELATED ART

Generally, for main bridges with the same area, the approximate cost of using cast-in-place box girders is greater than the approximate cost of using pre-fabricated small box girders. Therefore, in terms of cost saving, the construction cost can be greatly reduced by choosing pre-fabricated small box girders for constructing a bridge deck of a road bridge. In addition, such a construction manner can further reduce the construction period.

When the bridge deck of the road bridge is constructed by using pre-fabricated small box girders, a plurality of pre-fabricated small box girders parallel to each other span two adjacent bridge piers in the longitudinal direction of the bridge deck (the length extension direction of the bridge deck). Pre-fabricated small box girders between two adjacent spans need to be spliced by a bent cap to implement the continuous pavement of the bridge deck.

During the construction of the foregoing bridge deck of the road bridge, a support system needs to be built in advance. For example, in a method of constructing a post-cast concealed bent cap for transforming a simply-supported girder into a continuous girder in Chinese Patent CN101538831A, a temporary support system is disclosed, in which Φ273×7 triple steel pipes are used as a vertical support (a pillar spacing is 12.5 m), and double 56*a* I steel is disposed as a temporary support girder for a hollow slab girder. In addition, to reduce a support girder span, a diagonal strut is added at the bottom of the vertical support, and various connecting rods are arranged for the diagonal strut to reduce a calculated length of the diagonal strut and improve the overall stability of a bracket system, so that the lower support forms a truss system. Because the support system is designed for the construction of a road bridge with a main bridge being a PC hollow slab girder (a span is 20 m, a girder height is 90 cm, and the weight of a single girder is 22.2 tons), for the construction of a road bridge with a main bridge being a pre-fabricated small box girder (90 ton/piece, which is more than three times the weight of a PC hollow slab girder). Such a support system has a limited load-bearing capacity and is therefore not applicable. In addition, more importantly, the support system is limited to the area of a bearing platform, and in the used truss system, to reduce a length ratio of a main support pillar, dense rod members are disposed in a support area. During construction, vehicles (used for transporting components or pre-fabricated small box girders of the support system) cannot pass. As a result, the removal of the support system is required, and it is impossible to adequately increase the transportation capacity to improve the construction efficiency of the bridge deck.

SUMMARY

The present invention provides a method for removal of a temporary support system for a road bridge pre-fabricated small box girder-type concealed bent cap, so that after a road bridge pre-fabricated small box girder-type concealed bent cap is constructed, a temporary support system for the road bridge pre-fabricated small box girder-type concealed bent cap built before the road bridge pre-fabricated small box girder-type concealed bent cap is constructed can be effectively removed.

To achieve the foregoing technical objective, the present invention adopts the following technical solutions:

A method for removal of a temporary support system for a road bridge pre-fabricated small box girder-type concealed bent cap includes the following steps:

(1) removing cantilever beams:

first lifting the cantilever beams with a truck crane, then removing connections between the cantilever beams and a main beam, and finally lifting the cantilever beams with the truck crane to a flatbed truck for removal;

(2) removing lateral pier support systems and loading same onto a truck:

near two ends of an outer-side main beam section in the length extension direction, lifting a side close to each lateral pier support system by using first hoisting equipment, hoisting a side close to a main pier support system by using second hoisting equipment, and then removing connections between the outer-side main beam section and lateral pier vertical supports, so that the lateral pier vertical supports can be hoisted onto a flatbed truck by using a truck crane;

(3) removing the outer-side main beam section connected to the lateral pier support system and loading same onto a truck:

after the lateral pier vertical support is removed and a connection between the outer-side main beam section and a main beam middle section is removed, simultaneously starting the first hoisting equipment and the second hoisting equipment used in step (2), lowering the outer-side main beam section to the ground, then pulling the outer-side main beam section outside the projection area of a pre-fabricated small box girder by using a truck crane, and hoisting the outer-side main beam section onto a flatbed truck;

(4) removing, horizontally displacing, and lowering the main beam middle section connected to the main pier support system:

after the main beam middle section is lifted by using movable hoisting equipment, removing a link between the main beam middle section and a main truss system, then starting a horizontal-displacement apparatus of the movable hoisting equipment, transporting a main beam section a near a midspan, then starting a lifting mechanism of the movable hoisting equipment, and lowering the main beam middle section onto a flatbed truck;

(5) hoisting, lowering, and laying flat the main truss system and loading same onto a truck: starting the horizontal-displacement apparatus of the movable hoisting equipment, and enabling the movable hoisting equipment to reset; and hoisting the main truss system, and then removing a constraint between the main truss system and a main pier vertical support;

starting the horizontal-displacement apparatus, transporting the main truss system near the midspan, and finally lowering and laying flat the main truss system by using the lifting mechanism of the movable hoisting equipment;

replacing a connecting position between the lifting mechanism in displaceable hoisting equipment and the main truss system, until the displaceable hoisting equipment can move the main truss system in a lying state to a flatbed truck; and (6) removing the main pier vertical support system and a pad beam:

starting the horizontal-displacement apparatus, restoring the movable hoisting equipment at a section of the pre-fabricated small box girder above the original support, hoisting the main pier vertical support system, and then removing a link between the main pier vertical support system and the pad beam; and then starting the horizontal-displacement apparatus to move the main pier vertical support system near the midspan, and finally starting an electric hoist to move the main pier vertical support system to a flatbed truck.

Further, the first hoisting equipment used in step (2) includes a cantilever crossbeam, a counter-pressure crossbeam, a first lifting mechanism, and an anchored pier head;

the cantilever crossbeam can be disposed spanning the width of the concealed bent cap;

at least one counter-pressure crossbeam is disposed on the upper surface of the cantilever crossbeam;

the first lifting mechanism is fixed below the cantilever crossbeam; and the anchored pier head is arranged at the top of the counter-pressure crossbeam, an anchor bolt of the anchored pier head is fixed to the cast-in-place concealed bent cap, and the cantilever crossbeam is tightly pressed between the counter-pressure crossbeam and the cast-in-place concealed bent cap through anchoring of the cast-in-place concealed bent cap by the anchored pier head fixed on the counter-pressure crossbeam.

Further, the second hoisting equipment used in step (2) includes a supporting crossbeam, a foundation beam, and a second lifting mechanism; and the foundation beam includes a foundation beam a and a foundation beam b;

the supporting crossbeam spans above two adjacent pre-fabricated small box girders; and one end of the supporting crossbeam is fixed to the cast-in-place concealed bent cap by the foundation beam a, whereas the other end is fixed to a top pad beam arranged on the pre-fabricated small box girder by the foundation beam b; and the second lifting mechanism is supported in a lifted manner on the supporting crossbeam, and a lifting end of the second lifting mechanism can pass through a gap between the two adjacent pre-fabricated small box girders to be fixed to a side, close to the main pier support system, of the outer-side main beam section.

Further, the movable hoisting equipment used in step (4) includes the horizontal-displacement apparatus, the lifting mechanism, and a moving cart that can be driven by the power of the horizontal-displacement apparatus to carry the lifting mechanism to reciprocate along a movable track; and the lifting mechanism is assembled on the moving cart, and a lifting end of the lifting mechanism can pass through a gap between two adjacent pre-fabricated small box girders to be fixed to the main beam middle section;

the movable track is paved in the longitudinal direction; and the horizontal-displacement apparatus includes a power mechanism, and an output end of the power mechanism is fixed to the moving cart by a traction steel wire rope; and the power mechanism is arranged in the area of the cast-in-place concealed bent cap by a counterforce bracket.

Further, the moving cart includes a support crossbeam and a foundation crossbeam; the upper end of the foundation crossbeam is fixed to the support crossbeam, whereas the lower end is provided with a roller wheel movable along the movable track; and the lifting mechanism is assembled on a supporting crossbeam.

Further, two horizontal-displacement apparatuses, two moving carts, and two movable tracks are symmetrically distributed on two sides of the centerline of a road in the transverse direction.

Further, a power source of the horizontal-displacement apparatus is a continuous jack, and the continuous jack is fixed to the area of the cast-in-place concealed bent cap by a counterforce frame.

Further, the bottom of the counterforce frame is anchored in the concealed bent cap, whereas a manual hoist used for hoisting the continuous jack is disposed at the top.

Another technical objective of the present invention is to provide removal equipment for a temporary support system for a road bridge pre-fabricated small box girder-type concealed bent cap, including a horizontal-displacement apparatus, a lifting mechanism, and a moving cart that can be driven by the power of the horizontal-displacement apparatus to carry the lifting mechanism to reciprocate along a movable track;

the lifting mechanism is assembled on the moving cart, and a lifting end of the lifting mechanism can pass through a gap between two adjacent pre-fabricated small box girders to be fixed to a main beam middle section; the movable track is paved in the longitudinal direction; and the horizontal-displacement apparatus includes a power mechanism, and an output end of the power mechanism is fixed to the moving cart by a traction steel wire rope; and the power mechanism is arranged in the area of the cast-in-place concealed bent cap by a counterforce bracket.

Further, two horizontal-displacement apparatuses, two moving carts, and two movable tracks are symmetrically distributed on two sides of the centerline of a road in the transverse direction.

According to the foregoing technical solution, compared with the prior art, the present invention has the following beneficial effects:

This application resolves the removal of a large-scale temporary measurement structure (the temporary support system for a road bridge pre-fabricated small box girder-type concealed bent cap) in a limited headway state. In an aspect, in the technical solution, a plurality of sets of temporary support members based on a pre-fabricated small box girder and a bent cap are provided, to implement the vertical hoisting of a member by an electric hoist. In another aspect, by means of a combination of "a continuous jack+a track cart", to implement a horizontal moment of a member. By means of the combination of a plurality of systems, a large-scale temporary support system in the projection area of the pre-fabricated small box girder may be rapidly removed following completion of pre-fabricated small box girder construction, to obviate the need for the operating space used by such equipment as traditional, heavy-duty truck cranes and crawler cranes. In addition, the system may further be widely applied to removal of other similar structures in limited space, thereby achieving adequate applicability.

DESCRIPTION OF THE EMBODIMENTS

Figure 1:
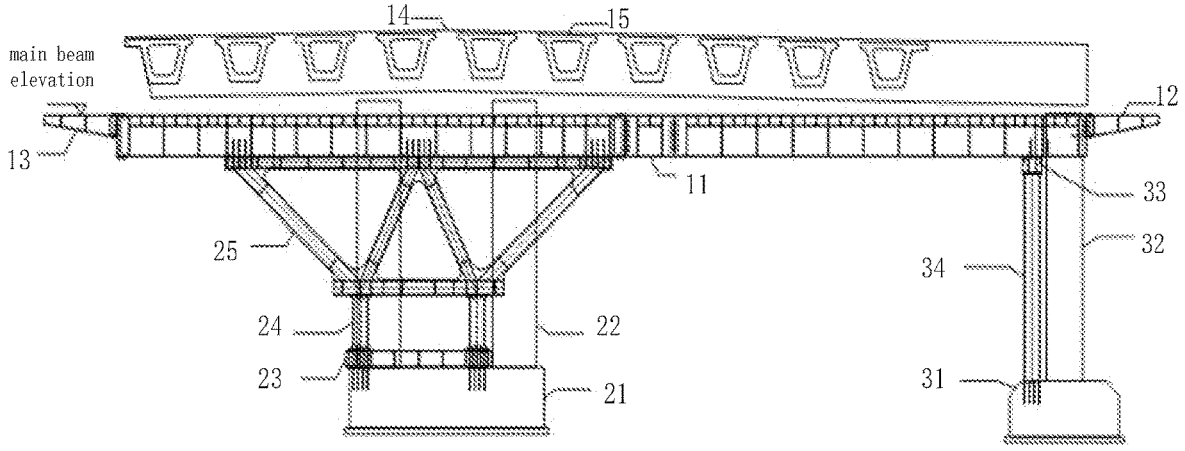
FIG. 1 is a schematic structural diagram of a temporary support system for a road bridge pre-fabricated small box girder-type concealed bent cap.

The following clearly and completely describes the technical solutions in the embodiments of the present invention with reference to the accompanying drawings in the embodiments of the present invention. Apparently, the described embodiments are only some embodiments of the present invention rather than all the embodiments. The following description of at least one exemplary embodiment is merely illustrative in nature and is in no way intended to pose any limitation on the present invention and its application or use. All other embodiments obtained by persons of ordinary skill in the art based on the embodiments of the present invention without creative efforts fall within the protection scope of the present invention. Unless specifically stated otherwise, the relative arrangements, expressions, and values of the components and steps set forth in these embodiments do not limit the scope of the present invention. In addition, it should be understood that for ease of description, the dimensions of the various parts shown in the drawings are not drawn in accordance with actual scale relationships. Techniques, methods, and apparatuses known to those of ordinary skill in the relevant art may not be discussed in detail, but the techniques, methods and apparatuses should be considered as part of the authorized specification if appropriate. In all examples shown and discussed herein, any specific value should be interpreted to be illustrative only but not restrictive. Therefore, other examples of the exemplary embodiments may have different values.

For ease of description, spatially relative terms such as "on", "above", "on the surface of", "upper", etc. may be used herein to describe a spatial positional relationship between one device or feature and another device or feature as shown in the figures. It should be understood that the spatially relative terms are intended to encompass different orientations of the device in use or operation in addition to the orientation of the device depicted in the figures. For example, if a device in the figures is turned upside down, the device described as "above other devices or structures" or "on other devices or structures" will be positioned as "below other devices or structures" or "under other devices or structures". Thus, the exemplary term "above" may include both orientations of "above" and "below". The device may also be positioned in other different manners (the device is rotated by 90 degrees or positioned in other orientations).

Figure 2:
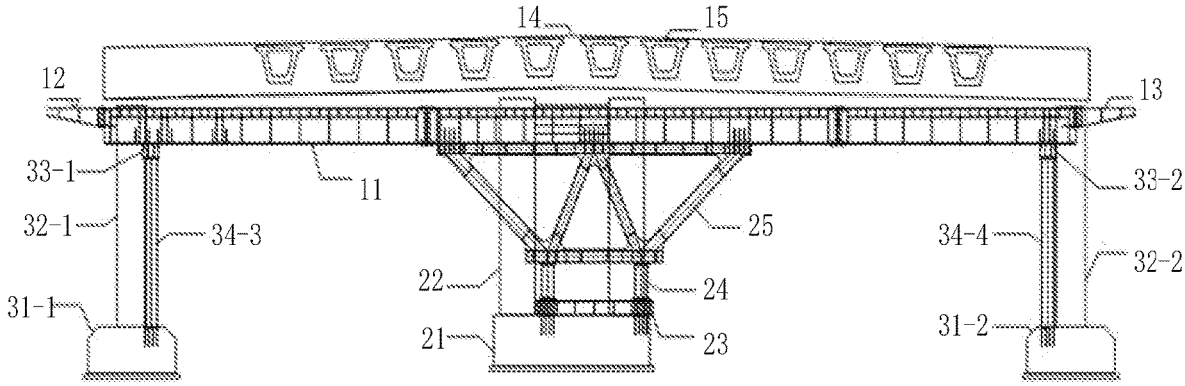
FIG. 2 is a schematic structural diagram of another temporary support system for a road bridge pre-fabricated small box girder-type concealed bent cap.

For ease of description of a method for removal of a temporary support system for a road bridge pre-fabricated small box girder-type concealed bent cap in the present invention, an object to be removed in the present invention needs to be described herein in advance: a temporary support system for a road bridge pre-fabricated small box girder-type concealed bent cap. FIG. 1 and FIG. 2 show two different embodiments of the temporary support system. Details are recorded as follows:

Embodiment 1

As shown in FIG. 1, this embodiment discloses a cantilever support system, used for supporting a road bridge pre-fabricated small box girder-type concealed bent cap. The support system includes a main beam 11, a main pier support system, and a lateral pier support system 34. The main beam 11 is arranged on the transverse side of ("transverse" refers to the width direction of a bridge deck of a road bridge, that is, the horizontal direction in FIG. 1) road bridge piers, and is formed by splicing two sections, including a main beam section a supported by the main pier support system and a main beam section b with one end supported on the lateral pier support system 34 and the other end capable of being spliced to the main beam section a. the road bridge piers includes a main pier and a lateral pier. The main pier includes a main pier bearing platform 21 and a main pier column 22 disposed on the main pier bearing platform 21. The lateral pier includes a lateral pier bearing platform 31 and a lateral pier column 32 disposed on the lateral pier bearing platform 31.

To reduce the cost of temporary measures and reduce the steel structure usage of the main beam 11, correspondingly a first cantilever beam 12 and a second cantilever beam 13 are separately assembled at two ends of the main beam 11 for use as a construction operation platform and a support platform for a bracket of a part of the cast-in-place concealed bent cap. Cantilever beams use a variable-cross section I-shaped structure. To match with the main beam 11, the cantilever beams are in a double state, and the width of a single girder flange slab is consistent with the width of a flange of a single main beam 11 of the main beam 11. The cantilever beams and the main beam 11 are connected by a high-strength bolt.

The main pier support system is disposed on the transverse side of a main pier area and is located under the main beam 11. The lower end of the main pier support system is fixed to the main pier bearing platform 21, whereas the upper end is fixed to the main beam 11. In the drawing, the main pier support system is disposed on the outer side of the main pier column 22 in the transverse direction.

To meet road bridge support requirements for pre-fabricated small box girder-type concealed bent caps, the main pier support system in the present invention includes a main pier pad beam 23, a main pier vertical support 24, and a main truss system 25.

The main truss system 25 includes a top chord slab, a bottom chord slab, and a W-shaped truss disposed between the top chord slab and the bottom chord slab. The W-shaped truss is formed by two external web rods and two internal web rods. The two internal web rods form an inverted V-shaped member at a middle position of the W-shaped truss. The two external web rods are symmetrically arranged on the outer side of the inverted V-shaped member, and a tilt angle of the external web rod relative to a bottom chord rod is 42.3° (preferably not less than 40°). In addition, the total length of the truss does not exceed the maximum length of 17 m of a universal flatbed truck. Therefore, when it is chosen that the total length of a top chord rod is 16 meters and the total height of the W-shaped truss is 5 m, a tilt angle of the internal web rod is 65 degrees.

There are two main pier vertical supports 24, including a first main pier vertical support 24 and a second main pier vertical support 24, both disposed between the lower end of the W-shaped truss and the pad beam. The upper ends of the first main pier vertical support and the second main pier vertical support 24 can both be connected and fixed to the lower surface of the bottom chord slab by a detachable connecting member b, whereas the lower ends of the first main pier vertical support and the second main pier vertical support 24 can be fixed to the main pier pad beam 23 by a detachable connecting member c.

A joint site (connected by a flange connection) between the first main pier vertical support 24 and the bottom chord slab is disposed corresponding to a position of the joint site E, and a joint site (connected by a flange connection) between the second main pier vertical support 24 and the bottom chord slab is disposed corresponding to a position of the joint site F.

The lateral pier support system 34 is disposed on the transverse side of a lateral pier area and is located below the main beam 11. The lower end of the lateral pier support system 34 is fixed to the lateral pier bearing platform 31, whereas the upper end is fixed to the main beam 11. In the drawing, the lateral pier support system 34 is disposed on the outer side of the lateral pier column 32 in the transverse direction.

Specifically, the lateral pier support system 34 includes a lateral pier vertical support. The upper end of the lateral pier vertical support is fixed and connected to the main beam 11 by a flange connection by using a bolt fastening member, whereas the lower end is fixed to the lateral pier bearing platform 31 by welding fixation.

A lateral pier support area is affected by the bending effect of the main beam 11 to cause nonuniform stress distribution in the support area. Due to the problem of a support point, a peak stress of the main beam 11 appears near the pad beam connected to the lateral pier vertical support. Therefore, a pad beam system perpendicular to a web slab of the main beam 11 (that is, the pad beam web slab and the web slab of the main beam 11 are arranged at 90°) is disposed. A lateral pier pad beam 33 is formed by using a welded steel box girder. One support reinforcing rib is disposed on the lateral pier pad beam 33 at an interval of 20 cm in the length direction of the web slab, and at a position corresponding to the web slab of the main beam 11, reinforcing ribs are densely disposed in the cross-sectional direction (the remaining reinforcements are only arranged on the outer side of the web slab). In addition, to adapt to a stress concentration effect caused by the bending of the main beam 11, one longitudinal reinforcement is added on the outer side of the top slab, and corresponds to a partial support reinforcement of the main beam 11.

Embodiment 2

As shown in FIG. 2, differences between Embodiment 1 and Embodiment 2 of the present invention lie in that the support system in this embodiment is a temporary large-span support system for a road bridge pre-fabricated small box girder-type concealed bent cap. The main beam 11 is formed by splicing three main beam sections. The three main beam sections are a main beam section a, a first main beam section b, and a second main beam section b. The main beam section a is joined to a main truss system. One end of the first main beam section b is supported on a lateral pier bearing platform of a first lateral pier, whereas the other end is spliced to one end of the main beam section a. One end of the second main beam section b is supported on the lateral pier bearing platform of a second lateral pier, whereas the other end is spliced to the other end of the main beam section a. In addition, in this embodiment, one lateral pier is separately provided on two sides of a main pier of a road bridge. Therefore, in the support system, one lateral pier support system is disposed for each lateral pier, and one main pier support system is disposed for the main pier. A main beam is supported by the foregoing main pier support system and the lateral pier support systems symmetrically disposed on two sides of the main pier support system.

After an inter-span pre-fabricated small box girder 15 is hoisted in position and the construction of the concealed bent cap 14 is completed, the foregoing temporary support system needs to be removed. The removal follows the following principles:

1) removing cantilever beams and a distribution beam first, and then removing the main support system, mainly, an outer-side main beam section 11-1, a main beam middle section 11-2, the main truss system, a main pier vertical support, a main pier pad beam, and a lateral pier vertical support system;

2) keeping a 21-*m* main beam section (the main beam middle section 11-2), the main truss system, the main pier vertical support, and the main pier pad beam in a main pier area, and first completing the lateral pier vertical support system and 12-*m* and 17-*m* main beam sections (the outer-side main beam section 11-1) related to the lateral pier vertical support system;

3) lateral pier support systems 34: removing a column first, and then removing the outer-side main beam section 11-1 of the main beam; and 4) a main pier support system 2: first removing the main beam middle section 11-2 of the main beam, and then removing the truss, and finally removing the column and the main pier pad beam.

The machine for constructing the pre-fabricated small box girder 15 mainly include four types: "1) a bridge-building machine", "2) a truck crane", "3) a crawler crane", and a "4) a gantry crane". In consideration of the actual condition of the section of the concealed bent cap 14, only the truck crane can be selected for hoisting in the present invention mainly for the following reasons:

(1) The bridge-building machine requires sufficient vertical and horizontal load-bearing capacities provided by the support system, and as a result there is relatively high potential safety hazards.

(2) The crawler crane requires an excessively long wait time, and has low economic benefit.

(3) The gantry crane is limited by a variable-width section, and similar large-span heavy-duty equipment incurs extremely high use cost.

In summary, the present invention adopts a truck crane to operate equipment for constructing the pre-fabricated small box girder 15 of the section of the concealed bent cap 14.

During the removal of the temporary support system, under the impact of the construction of the pre-fabricated small box girder 15, a truck crane has limited operating space. Therefore, a specific mode needs to be used for construction, and the key process includes the following four points:

1) The cantilever beams, the lateral pier vertical support, and the pad beam are located outside the projection area of the main beam, and therefore a truck crane is used for hoisting and removal.

Figure 5A:
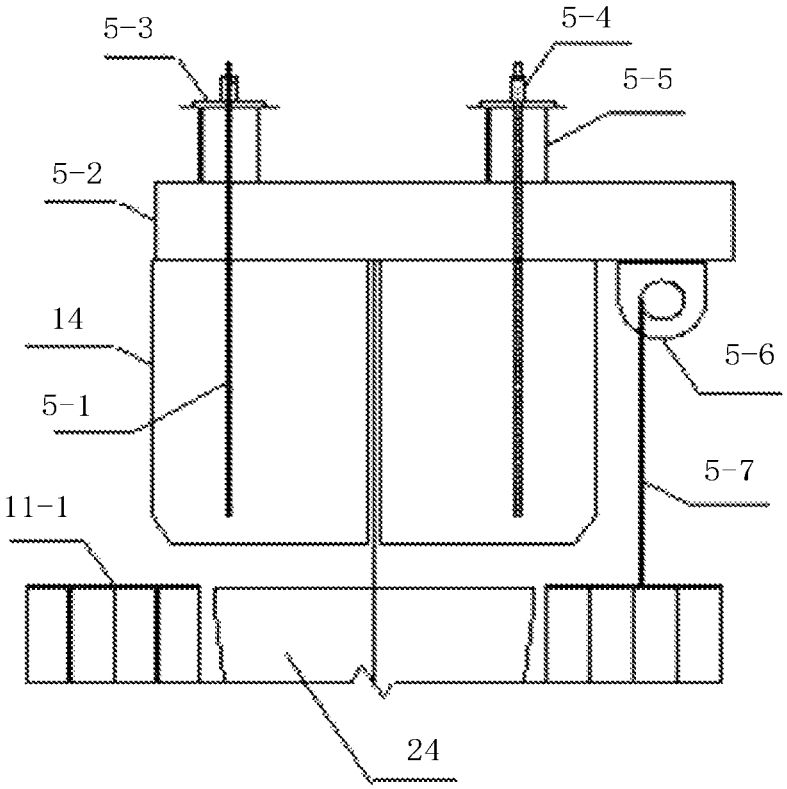
FIG. 5*a* is a schematic structural diagram of first hoisting equipment (in the longitudinal direction) in FIG. 4*c;*
Figure 5B:
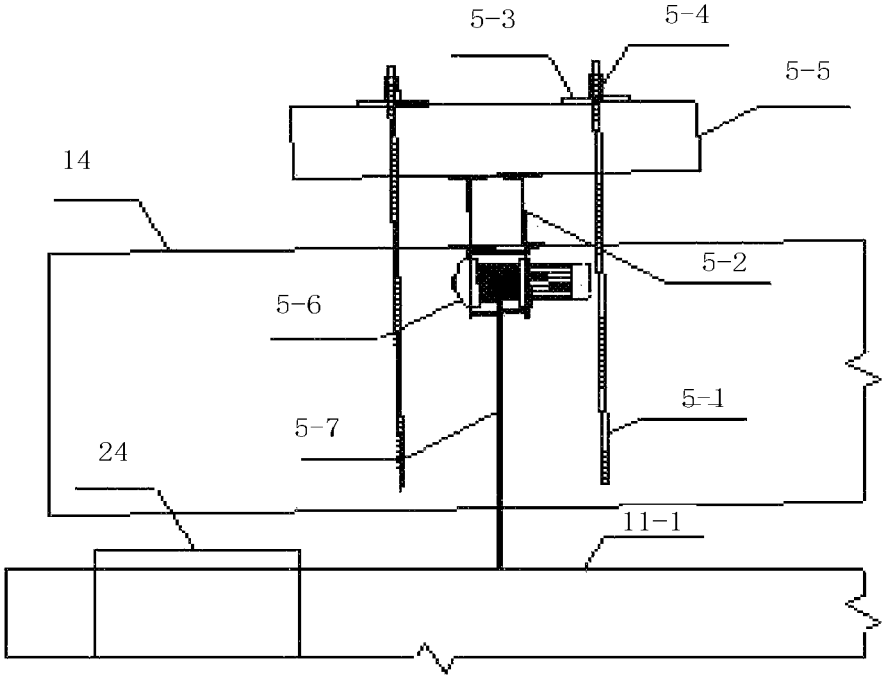
FIG. 5*b* is a schematic structural diagram of first hoisting equipment (in the transverse direction) in FIG. 4*c;*
Figure 6A:
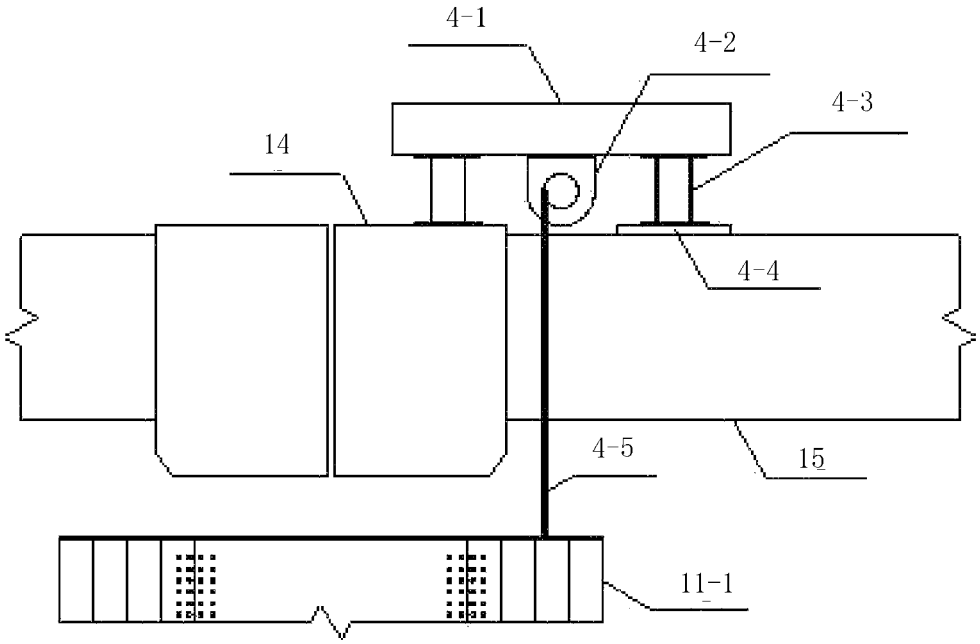
FIG. 6*a* is a three-dimensional structural diagram of second hoisting equipment (in the longitudinal direction) in FIG. 4*c;*
Figure 6B:
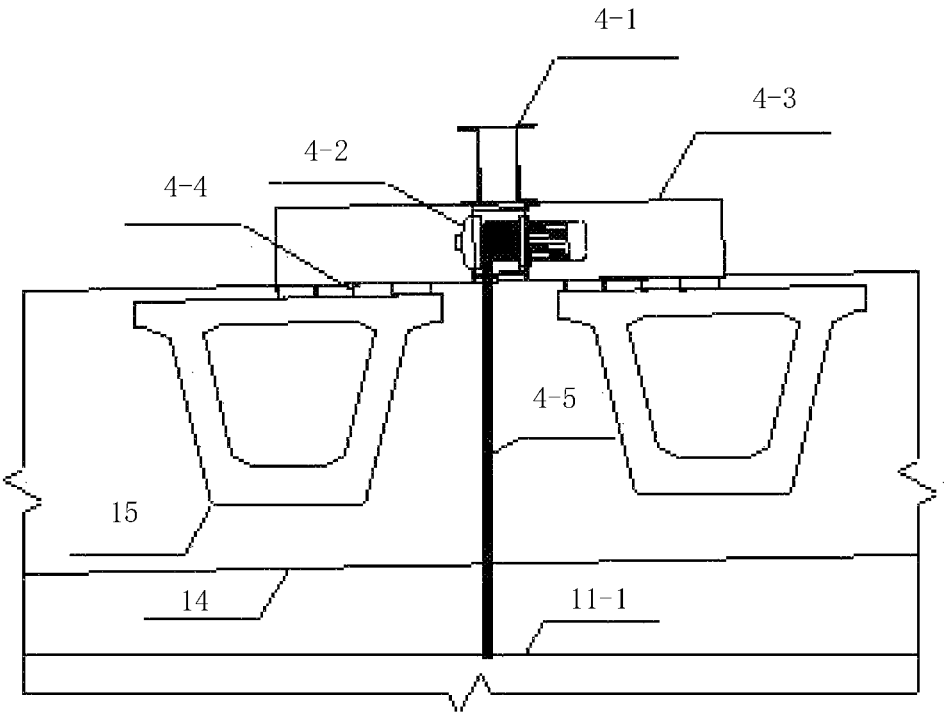
FIG. 6*b* is a three-dimensional structural diagram of second hoisting equipment (in the transverse direction) in FIG. 4*c,*

2) The outer-side main beam section 11-1 (the foregoing main beam section b in Embodiment 1 or the first main beam section b or the second main beam section b in Embodiment 2) connected to the lateral pier vertical support is first fixed to the concealed bent cap 14 (for the temporary hanging structure, reference may be made to first hoisting equipment 5 in FIG. 5*a* and FIG. 5*b* for details) or the pre-fabricated small box girder 15 (for the temporary hanging structure, reference may be made to second hoisting equipment 4 shown in FIG. 6*a* and FIG. 6*b* for details) by an electric hoist. After the temporary support for the lateral pier is removed, a connection between the temporary support and the main beam section a is removed, the electric hoist is then started, the outer-side main beam section 11-1 (the main beam section b, the first main beam section b or the second main beam section b) is lowered to the ground and then pulled outside the projection area of the pre-fabricated small box girder 15 by using a truck crane, and the outer-side main beam section 11-1 is hoisted onto a flatbed truck.

As shown in FIG. 5*a* and FIG. 5*b*, the first hoisting equipment 5 includes a first lifting mechanism. A fixed end of the first lifting mechanism is fixed on the concealed bent cap 14, whereas a lifting end of the first lifting mechanism can be fixed to a side, close to each lateral pier support system 34, of the outer-side main beam section 11-1.

As shown in FIG. 6*a* and FIG. 6*b*, the second hoisting equipment 4 includes a second lifting mechanism. The fixed end of the second lifting mechanism is partially fixed on the concealed bent cap 14 and is partially fixed to the pre-fabricated small box girder 15 above the outer-side main beam section 11-1, whereas a lifting end of the second lifting mechanism can pass through a gap between two adjacent pre-fabricated small box girders 15 to be fixed to a side, close to the main pier support system 2, of the outer-side main beam section 11-1.

The first lifting mechanism and the second lifting mechanism have consistent structures and both include an electric hoist and a steel wire rope connected to a power output end of the electric hoist. An end portion of the steel wire rope can pass through a gap between the two adjacent pre-fabricated small box girders 15 to be fixed to a side, close to the main pier support system 2, of the outer-side main beam section 11-1. That is, the first lifting mechanism includes a first electric hoist 5-6 and a first steel wire rope 5-7 connected to a power output end of the first electric hoist 5-6. An end portion of the first steel wire rope 5-7 can pass through the gap between the two adjacent pre-fabricated small box girders 15 to be fixed to one side, close to the main pier support system 2, of the outer-side main beam section 11-1. The second lifting mechanism includes a second electric hoist 4-2 and a second steel wire rope 4-5 connected to a power output end of the second electric hoist 4-2. An end portion of the second steel wire rope 4-5 can pass through the gap between the two adjacent pre-fabricated small box girders 15 to be fixed to another side, close to the main pier support system 2, of the outer-side main beam section 11-1.

Specifically, the fixed end of the first lifting mechanism in the present invention is fixed on the concealed bent cap 14 by a first fixation structure. The first fixation structure includes a cantilever crossbeam 5-2, a counter-pressure crossbeam 5-5, and an anchored pier head 5-4. The cantilever crossbeam 5-2 can be disposed spanning the width of the concealed bent cap 14. At least one counter-pressure crossbeam 5-5 is disposed on the upper surface of the cantilever crossbeam 5-2. The anchored pier head 5-4 is arranged at the top of the counter-pressure crossbeam 5-5, and an anchor bolt (a pre-embedded bolt 5-1) of the anchored pier head 5-4 is fixed to the cast-in-place concealed bent cap 14. The cantilever crossbeam 5-2 is tightly pressed between the counter-pressure crossbeam 5-5 and the cast-in-place concealed bent cap 14 through anchoring of the cast-in-place concealed bent cap 14 by the anchored pier head 5-4 fixed on the counter-pressure crossbeam 5-5. An anchor backing plate 5-3 is disposed between the anchored pier head 5-4 and the counter-pressure crossbeam 5-5. The fixed end of the first lifting mechanism is fixed below the cantilever crossbeam 5-2. As can be seen, in the present invention, at a mounting position of the first lifting mechanism on the concealed bent cap of the pre-fabricated small box girder 15, there is only a concealed bent cap 14 but there is no pre-fabricated small box girder 15. Therefore, the cantilever crossbeam 5-2 is arranged for the first fixation structure of the first lifting mechanism for support.

In the present invention, a fixed end of the second lifting mechanism is separately connected to the concealed bent cap 14 and the pre-fabricated small box girder 15 by a second fixation structure. Specifically, the second fixation structure includes a supporting crossbeam 4-1 and a foundation beam 4-3. There are two foundation beams 4-3: a foundation beam a and a foundation beam b. One end of the supporting crossbeam 4-1 is fixed to one end of the foundation beam a, and the other end of the foundation beam a is fixed to the concealed bent cap 14 by a pad beam a. The other end of the supporting crossbeam 4-1 is fixed to one end of the foundation beam b 4-4, whereas the other end is fixed to the pad beam b 4-4 arranged on the pre-fabricated small box girder 15. The fixed end of the second lifting mechanism is fixed to the supporting crossbeam 4-1. The supporting crossbeam 4-1 spans above two adjacent pre-fabricated small box girders 15. One end of the supporting crossbeam 4-1 is fixed to the cast-in-place concealed bent cap 14 by the foundation beam a, whereas the other end is fixed by the foundation beam b to the pad beam b 4-4 arranged on the pre-fabricated small box girder 15. As can be seen, the second fixation structure of the second lifting mechanism in the present invention uses a simply-supported support girder structure, and the centerline of the supporting crossbeam 4-1 of the second fixation structures is located in an interval between the pre-fabricated small box girders 15. In addition, to ensure the overall stability during hoisting, the simply-supported support girder is fixed by the two foundation beams (the foundation beams a and b). In consideration that the center of the temporary support system is only 1.8 m (slightly greater than a total width of 1.5 m of the concealed bent cap 14) away from the centerline of a bridge pier, the foundation beam at one end of the supporting crossbeam 4-1 is located on the cast-in-place concealed bent cap 14, whereas the other end of the supporting crossbeam 4-1 is located in the area of the pre-fabricated small box girder 15. To adjust a height difference of 10 cm between the concealed bent cap 14 and the pre-fabricated small box girder 15, channel steel is arranged at the bottom of the foundation beam of the pre-fabricated small box girder and is used as a pad beam.

3) Two pieces of temporary movable hoisting equipment (referring to FIG. 4*d*, FIG. 4*e*, and FIG. 7*a* to FIG. 7*c*) supported on the pre-fabricated small box girder 15 are used to fix the main beam section a in the main pier area, then a link between the main beam section a and the main truss system is removed, then a horizontal-displacement apparatus of the movable hoisting equipment is started, the main beam section a is transported near a midspan, and finally the electric hoist is started to lower the main beam section a onto the flatbed truck. For the details of the horizontal-displacement apparatus, reference may be made to FIG. 7*c*.

The two pieces of movable hoisting equipment are respectively first movable hoisting equipment and second movable hoisting equipment. The road bridge includes a plurality of bridge sections arranged in the longitudinal direction. Each bridge section includes a plurality of pre-fabricated small box girders 15 arranged in the longitudinal direction of the road bridge and a first concealed bent cap 14-1 and a second concealed bent cap 14-2 that are arranged in the transverse direction of the road bridge and are respectively cast in place at two ends of the pre-fabricated small box girder 15. The first movable hoisting equipment and the second movable hoisting equipment are symmetrically arranged on two sides of the centerline of the bridge section in the transverse direction, and are respectively fixed to the main beam middle section 11-2 and a W-shaped truss. It is ensured that hanging points cover the main truss and a main beam system in a position change state in the transverse direction.

As shown in FIG. 4*d*, FIG. 4*e*, and FIG. 7*a* to FIG. 7*c*, each piece of movable hoisting equipment includes a displaceable lifting mechanism, a track component, and a horizontal-displacement apparatus. The first movable hoisting equipment includes a first displaceable lifting mechanism 41, a first track component 42, and a first horizontal-displacement apparatus 43. The second movable hoisting equipment includes a second displaceable lifting mechanism 51, a second track component 52, and a second horizontal-displacement apparatus 53. One end of the track component is fixed to the first concealed bent cap 14-1, whereas the other end extends in the length direction of the pre-fabricated small box girder 15. The track component has a slit in communication with the gap between two adjacent pre-fabricated small box girders 15. As shown in FIG. 4*d*, FIG. 4*e*, FIG. 7*a*, and FIG. 7*b*, the displaceable lifting mechanism includes a moving cart horizontally displaceable along the track component and a lifting mechanism with a fixed end fixed to the moving cart. A lifting end of the lifting mechanism can sequentially pass through the slit of the track component and the gap between the two adjacent pre-fabricated small box girders 15 to be fixed to the main beam middle section 11-2 or the W-shaped truss below the first concealed bent cap 14-1. The horizontal-displacement apparatus is fixed to the second concealed bent cap 14-2, and a power output end of the horizontal-displacement apparatus is fixed to the moving cart by a traction portion member. The moving cart is actuated by power of the horizontal-displacement apparatus and is pulled by the traction portion member to horizontally displace along the track component. In this embodiment, the traction portion member is a traction steel beam 41-5.

Further, as shown in FIG. 4*d*, FIG. 4*e*, FIG. 7*a*, and FIG. 7*b*, the track component includes a movable track 42-1. An end, located in the longitudinal direction, of the movable track 42-1 is located above the first concealed bent cap 14-1, and the other end is divided in the longitudinal direction into two subtracks having a slit, which are correspondingly a first subtrack and a second subtrack. The first subtrack and the second subtrack are paved along two adjacent pre-fabricated small box girders 15, and track pad beams are respectively arranged between the first and second subtracks and the corresponding pre-fabricated small box girders 15. There are a total of two track pad beams: a track pad beam a 42-2 and a track pad beam b 42-3.

When the track is the movable track 42-1, it means that after assembly and disassembly, the track can be detached for repeated use a next time. 22*a* I-steel (a track length of a single side of each bridge pier is 9.0 m) is used for a single side of the track, and angle steel is welded at the top for use as a lateral limiting member. A track pad beam is paved at the bottom of the movable track 42-1. The track pad beam is perpendicular to the movable track 42-1 and is used for adjusting a height difference between the section of the cast-in-place concealed bent cap and the section of the pre-fabricated small box girder 15. Further, the moving cart includes a support crossbeam 41-1 and a foundation crossbeam 41-2. There are two foundation crossbeams 41-2: a foundation crossbeam a and a foundation crossbeam b. The support crossbeam 41-1 is disposed spanning the first subtrack and the second subtrack. Two ends of the support crossbeam 41-1 are respectively fixed to one end of the foundation crossbeam a and one end of the foundation crossbeam b in a one-to-one correspondence. The other end of the foundation crossbeam a and the other end of the foundation crossbeam b are respectively placed above the first subtrack and the second subtrack by roller wheels 41-7 adapting to the track component. The lifting mechanism includes an electric hoist 41-3 and a lifting steel wire rope 41-6 connected to the power output end of the electric hoist 41-3. A basement 41-8 of the electric hoist is fixed at a middle position of the support crossbeam 41-1. An end portion of the lifting steel wire rope 41-6 sequentially passes through the slit between the first subtrack and the second subtrack and the gap between the two adjacent pre-fabricated small box girders 15 to be fixed to the main beam middle section 11-2 or the W-shaped truss below the first concealed bent cap 14-1.

Figure 7A:
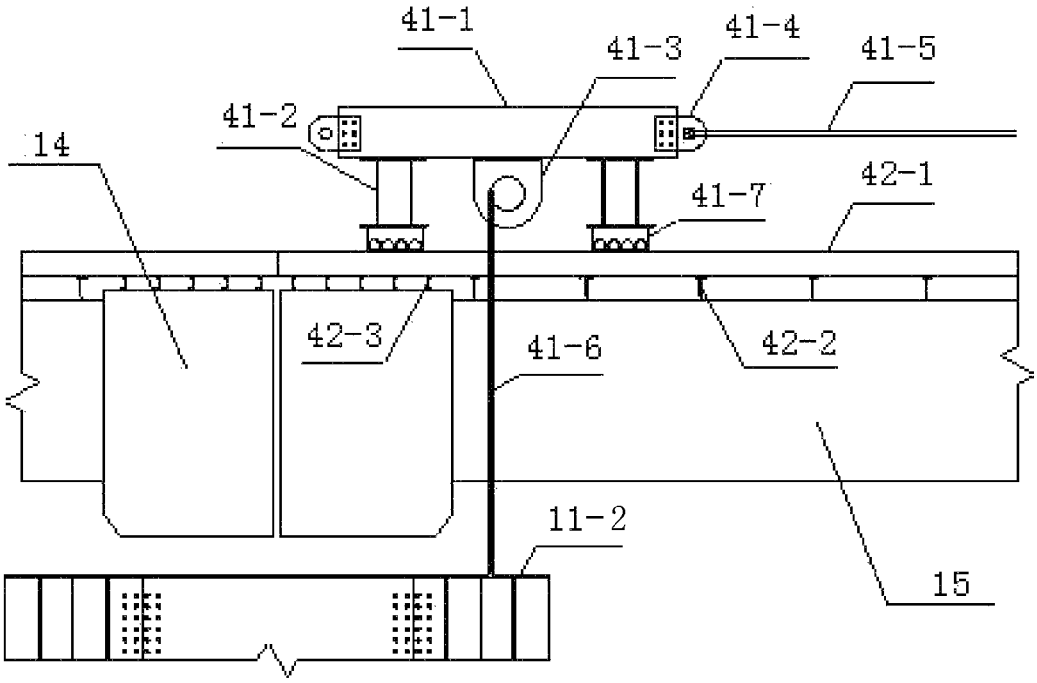
FIG. 7*a* is a schematic structural diagram of a first displaceable lifting mechanism (in the longitudinal direction) in FIG. 4*d;*
Figure 7B:
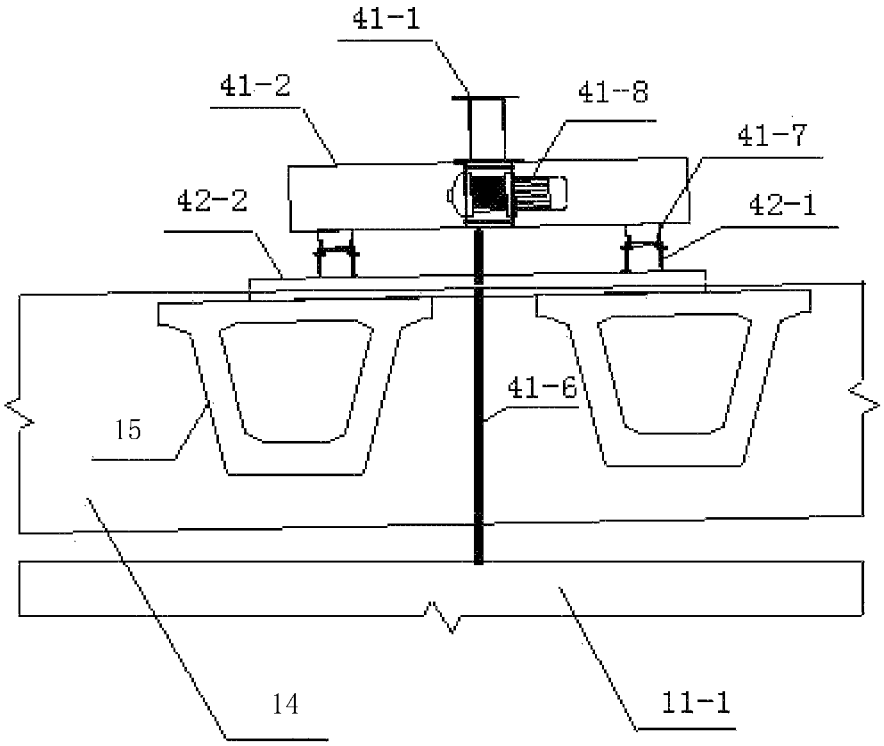
FIG. 7*b* is a schematic structural diagram of a first displaceable lifting mechanism (in the transverse direction) in FIG. 4*d;*
Figure 7C:
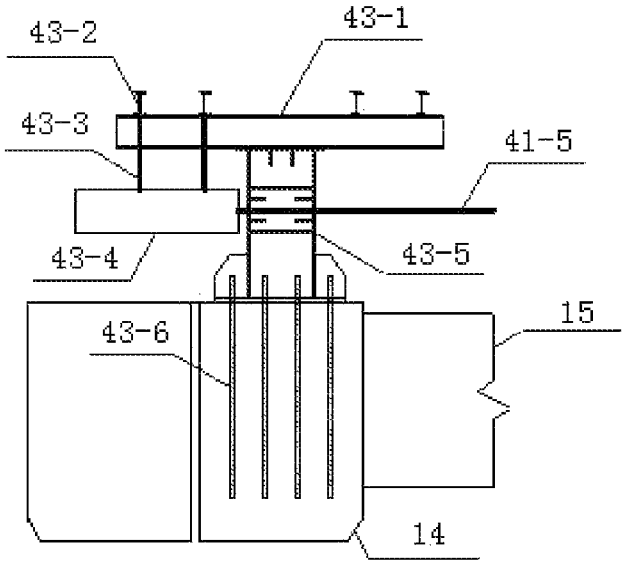
FIG. 7*c* is a structural diagram of a first horizontally displacement driving mechanism in FIG. 4*d*

Further, as shown in FIG. 7*c*, the horizontal-displacement apparatus includes a power mechanism. An output end of the power mechanism is fixed to a traction lifting lug 41-4 on the moving cart by the traction steel beam 41-5. The power mechanism is arranged in the area of the second concealed bent cap 14-2 by a counterforce frame component. The power mechanism is a continuous jack 43-4. The continuous jack 43-4 is fixed above the second concealed bent cap 14-2 by the counterforce frame component. The counterforce frame component includes a jack support beam 43-1, a manual hoist support beam 43-2, a manual hoist 43-3, a counterforce bracket 43-5, and an anchoring screw 43-6. The jack support beam 43-1 is mounted at an upper end of the counterforce bracket 43-5, whereas the lower end is anchored to the second concealed bent cap 14-2 by the anchoring screw 43-6. The manual hoist support beam 43-2 is fixed to the jack support beam 43-1. The fixed end of the manual hoist is fixed to the manual hoist support beam 43-2, whereas an actuation end of the manual hoist is fixed to the fixed end of the continuous jack 43-4. Manual hoist support beams 43-2 are symmetrically disposed at two ends of the jack support beam 43-1. The manual hoist can be fixed to either of the manual hoist support beams 43-2 at two ends of the jack support beam 43-1. Specifically, the counterforce frame uses a box-shaped cross section and has a double-sided extension function. The bottom of the counterforce frame is anchored in the concealed bent cap by finish rolled deformed steel bars. A manual hoist (used for hoisting the continuous jack 43-4) jig is disposed at the top of the counterforce frame, including two pieces of 45*a* I steel and four pieces of 22*a* I steel perpendicular to the 45*a* I steel. The manual hoist is hung at the 22*a* I steel.

4) The horizontal-displacement apparatus is started, the movable hoisting equipment at a section of the pre-fabricated small box girder 15 is restored above the original support, the main truss system is hoisted, and a constraint between the main truss system and the main pier vertical support is then removed.

5) A removal method similar to that for the main beam section a is used, and the main pier vertical support and the pad beam are hoisted onto a flatbed truck.

In summary, the core technologies for removing a bracket system for a concealed bent cap lie in that 1) hoisting equipment for a section of a concealed bent cap, 2) hoisting equipment for a section of the pre-fabricated small box girder 15, and 3) a horizontal-displacement apparatus.

Figure 4A:
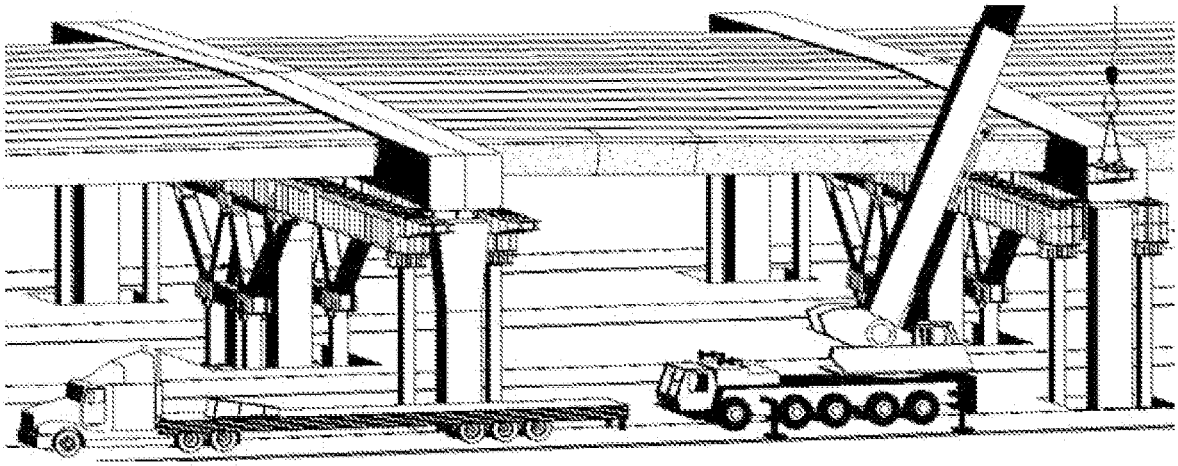
FIG. 4*a* is a schematic structural diagram of removal of cantilever beams by using a single 25-ton truck crane according to the present invention.
Figure 4B:
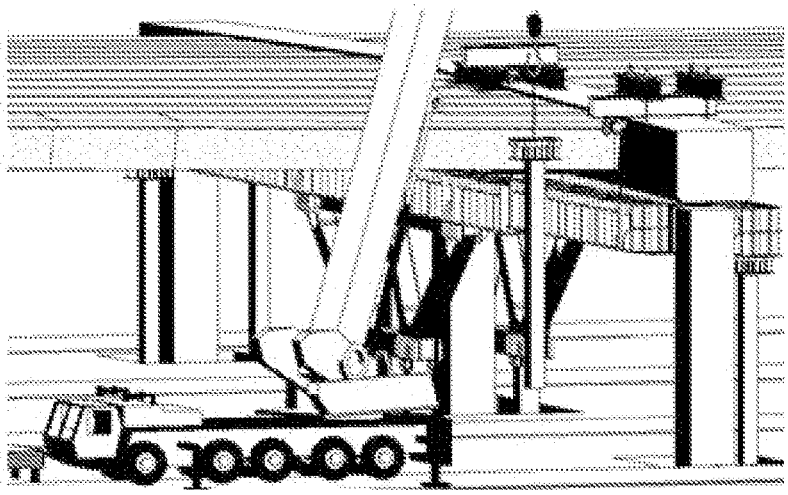
FIG. 4*b* is a schematic structural diagram of removal of a lateral pier vertical support system according to the present invention.

The hoisting equipment for the section of the concealed bent cap is the first hoisting equipment 5 used for hoisting a side, close to the outer-side main beam section 11-1 (the main beam section b in Embodiment 1 or the first main beam section b or the second main beam section b in Embodiment 2), of each lateral pier support system. As shown in FIG. 4*a* and FIG. 4*b*, the hoisting section of the concealed bent cap does not have the pre-fabricated small box girder 15. Therefore, a cantilever supporting crossbeam 4-1 is arranged, and the electric hoist is mounted. The cantilever supporting crossbeam 4-1 uses two counter-pressure crossbeams 5-5 for fixation. The anchored pier head 5-4 is arranged at the top of the counter-pressure crossbeams 5-5, and an anchor bolt constrained by the anchored pier head 5-4 is anchored to the cast-in-place concealed bent cap.

In summary, as can be seen, there are two types of hoisting equipment in the area of the pre-fabricated small box girder 15 of the present invention. One type of hoisting equipment is the second hoisting equipment 4 used for hoisting a side, close to the outer-side main beam section 11-1 (the main beam section b in Embodiment 1 or the first main beam section b or the second main beam section b in Embodiment 2), of the main pier support system 2, and uses a simply-supported support girder structure. The centerline of the support girder is located in an interval between the pre-fabricated small box girders 15. In addition, to ensure the overall stability during hoisting, the simply-supported support girder is fixed by two foundation beams, as shown in FIG. 6*a* and FIG. 6*b*. In consideration that the center of the support system is only 1.8 m (slightly greater than a total width of 1.5 m of the concealed bent cap) away from the centerline of each bridge pier, the foundation crossbeam 41-2 at one end of the support girder is located on the cast-in-place concealed bent cap, and the foundation at one end is located in the area of the pre-fabricated small box girder 15. To adjust a height difference of 10 cm between the concealed bent cap and the pre-fabricated small box girder 15, channel steel is arranged at the bottom of the foundation crossbeam 41-2 of the small box girder.

The other type of hoisting equipment is used for hoisting the main beam section a (the main beam middle section 11-2) and the main truss system located in the main pier area. In this case, in addition to meeting a vertical lowering function, the support member further needs to have a horizontal slide capability. Therefore, the horizontal-displacement apparatus is disposed at the bottom of the foundation crossbeam 41-2, and the movable track 42-1 is paved in the longitudinal direction. 22*a* I steel (a track length of a single side of each bridge pier is 9.0 m) is used on a single side of the track, and angle steel is welded at the top for use as the lateral limiting member. A track pad beam is paved at the bottom of the movable track 42-1. The track pad beam is perpendicular to the movable track 42-1, and is used for adjusting a height difference between the section of the cast-in-place concealed bent cap and the section of the pre-fabricated small box girder 15. A lifting lug structure used for the traction in the longitudinal direction is disposed at one web slab of the support girder, as shown in FIG. 7*a* and FIG. 7*b*.

The continuous jack 43-4 is used as a power source of the horizontal-displacement apparatus of hoisting equipment for the main pier area. The continuous jack 43-4 is arranged in the area of the cast-in-place concealed bent cap, and two continuous jacks 43-4 are disposed in the transverse direction and are symmetrically arranged on two sides of the centerline of the road, to ensure that hanging points cover the main truss and the main beam system in a position change state in the transverse direction.

The continuous jacks 43-4 in the longitudinal direction are disposed at two ends of each member in operating members (or each one), and hoisting equipment in the same direction is controlled to move. A maximum traction length of a single continuous jack 43-4 does not exceed 90 m.

As shown in FIG. 7*c*, in the horizontal-displacement apparatus, a single customized counterforce frame is arranged in an arrangement area of the continuous jack 43-4. The counterforce frame uses a box-shaped cross section and has a double-sided extension function. The bottom of the counterforce frame is anchored in the concealed bent cap by finish rolled deformed steel bars. A manual hoist (used for hoisting the continuous jack 43-4) jig is disposed at the top of the counterforce frame, including two pieces of 45*a* I steel and four pieces of 22*a* I steel perpendicular to the 45*a* I steel. The manual hoist is hung at the 22*a* I steel.

Figure 3:
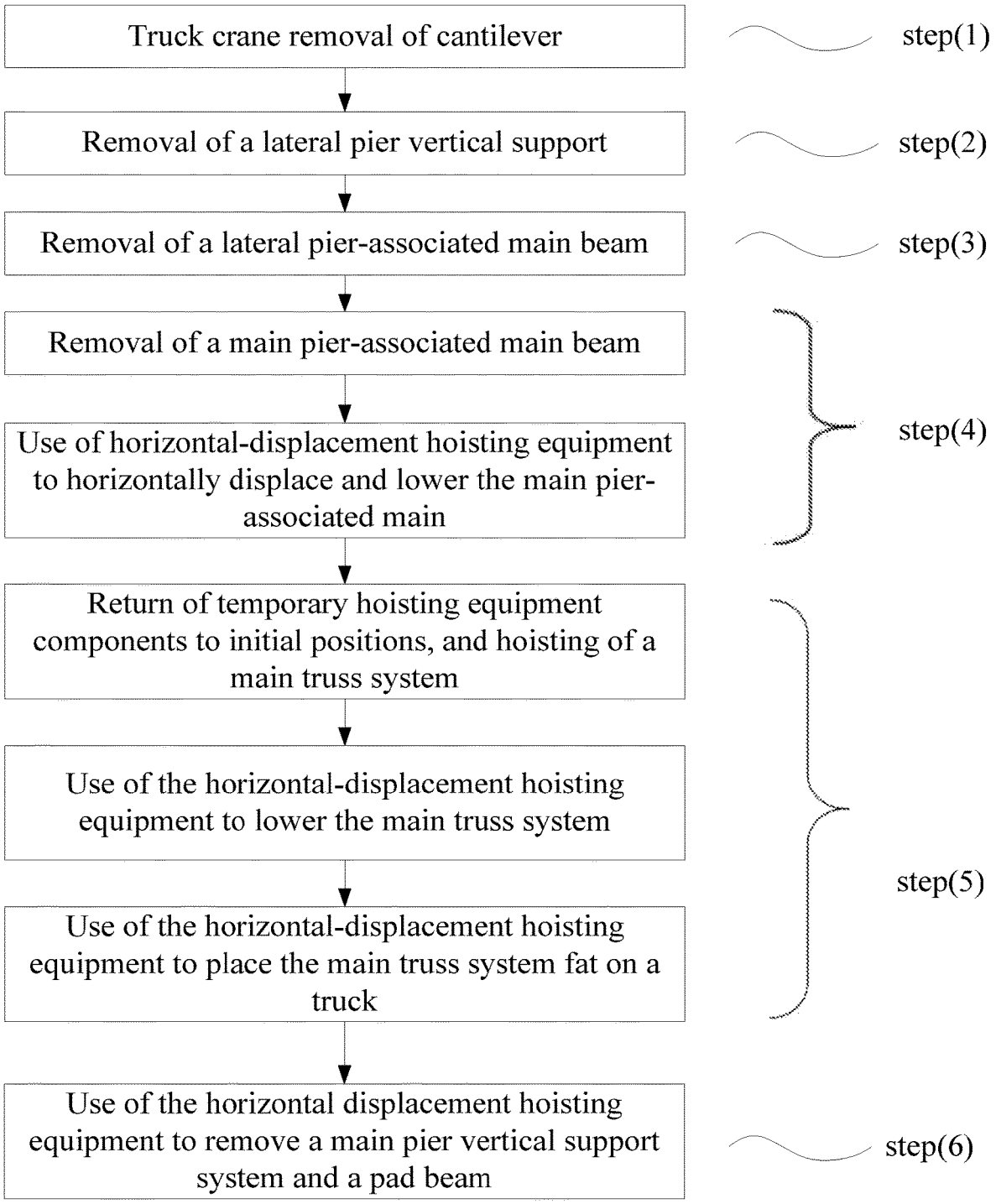
FIG. 3 shows a method for removal of a temporary support system for a road bridge pre-fabricated small box girder-type concealed bent cap according to the present invention.
Figure 4C:
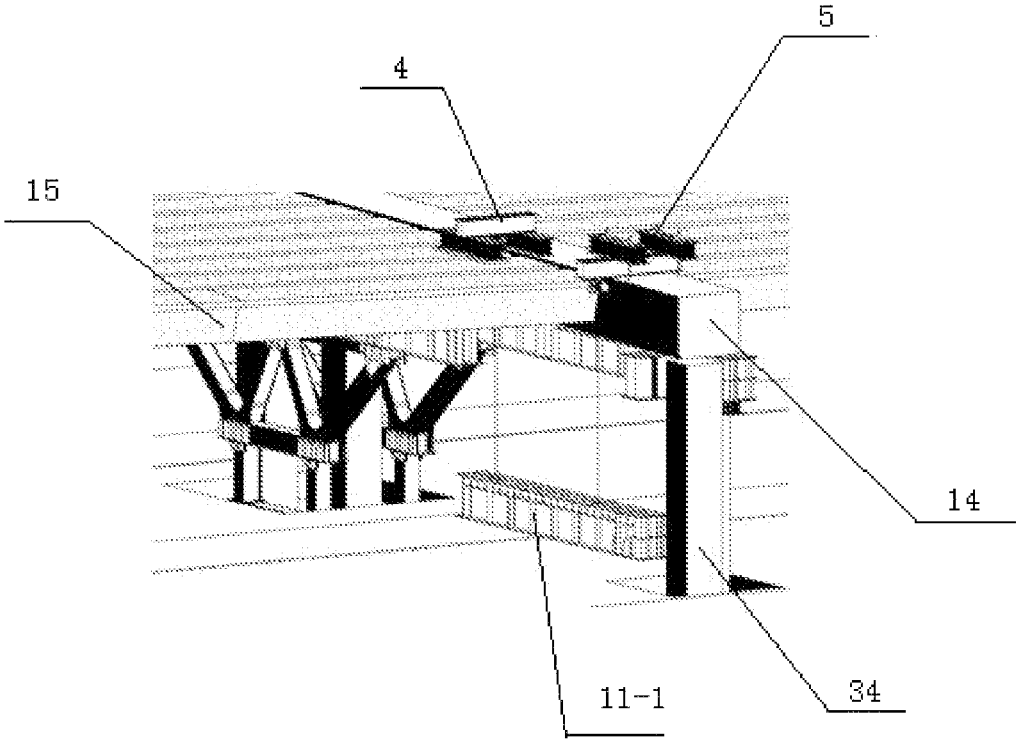
FIG. 4*c* is a schematic structural diagram of removal of a lateral pier-associated main beam according to the present invention.
Figure 4D:
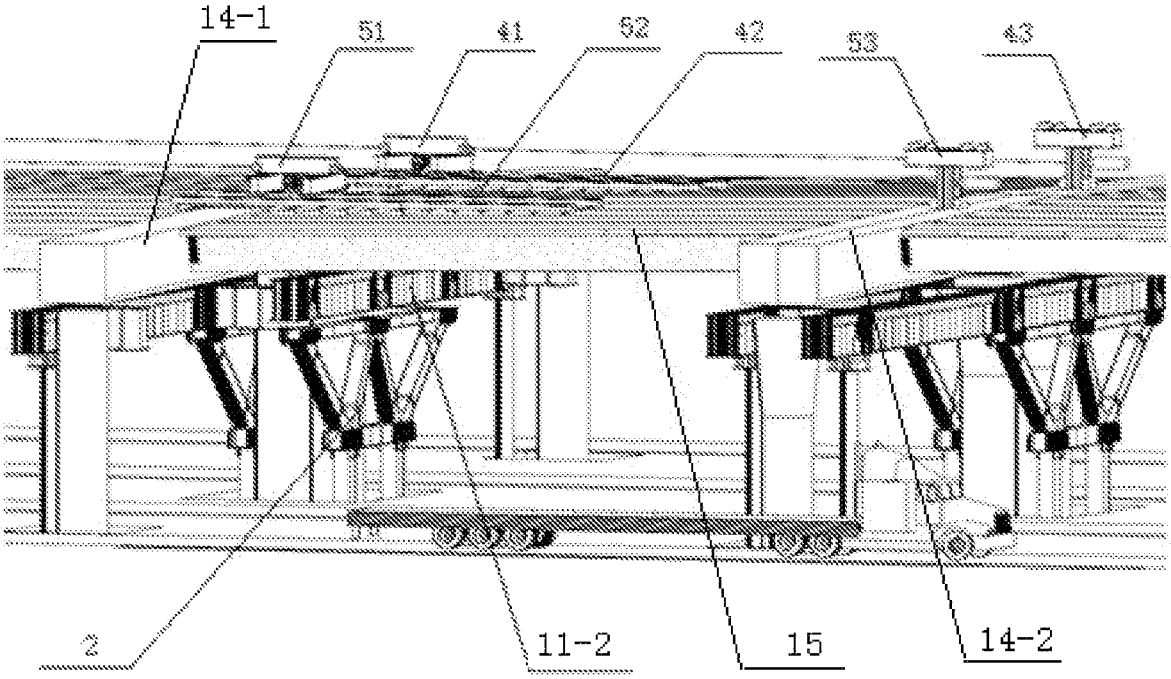
FIG. 4*d* is a schematic structural diagram of removal of a main pier-associated main beam according to the present invention.
Figure 4E:
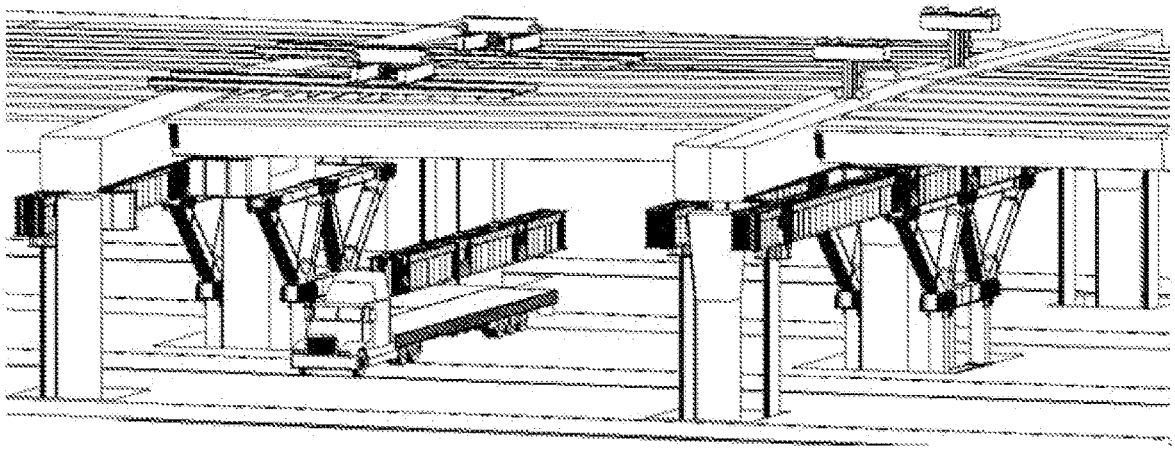
FIG. 4*e* is a schematic structural diagram of horizontally displacing and lowering a main pier-associated main beam by using displaceable hanging equipment according to the present invention.
Figure 4F:
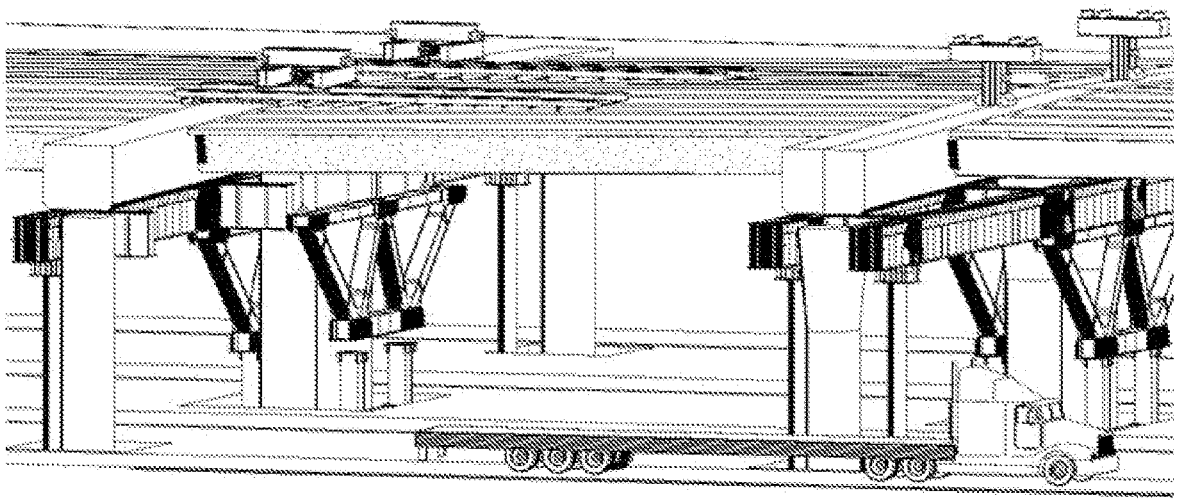
FIG. 4*f* is a schematic structural diagram of resetting displaceable hanging equipment and hoisting of a main truss system according to the present invention.
Figure 4G:
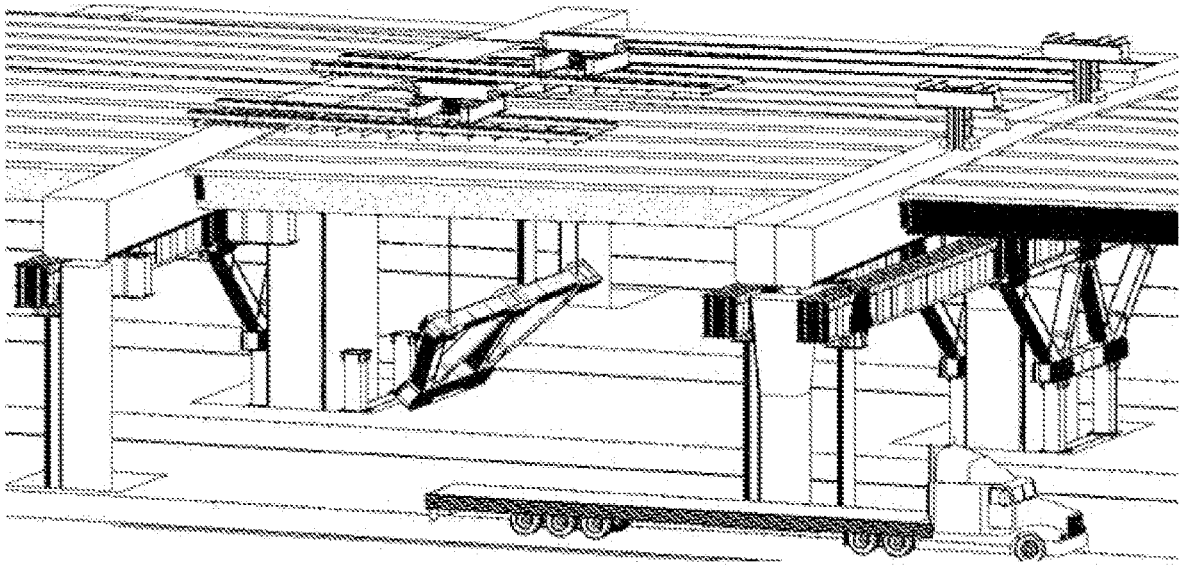
FIG. 4*g* is a schematic structural diagram lowering and laying flat a main truss system by using displaceable hanging equipment according to the present invention.
Figure 4H:
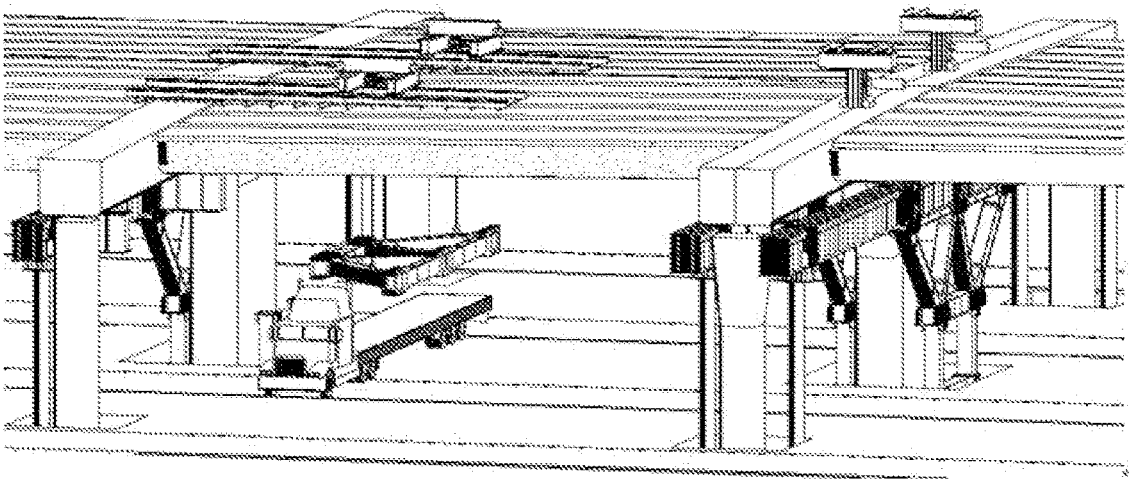
FIG. 4*h* is a schematic structural diagram of loading a main truss system in a lying state onto a truck by using displaceable hanging equipment according to the present invention.
Figure 4I:
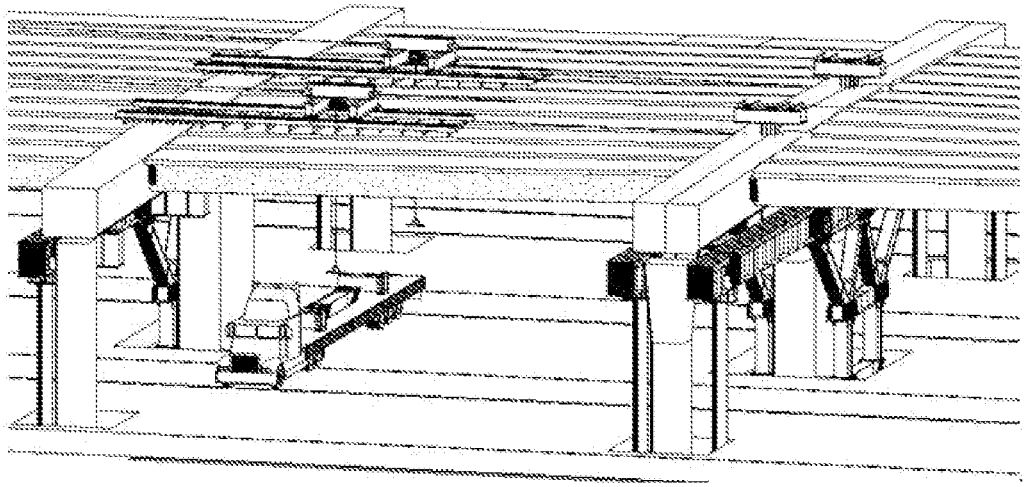
FIG. 4*i* is a schematic structural diagram of removing a main pier vertical support system and a pad beam by using displaceable hanging equipment according to the present invention.

Based on the foregoing principle and actual disclosure, as shown in FIG. 3 and FIG. 4*a* to FIG. 4*i*, specific removement operations in the present invention include the following steps:

(1) removing cantilever beams:

as shown in FIG. 4*a*, first lifting the cantilever beams with a truck crane, then removing connections between the cantilever beams and a main beam, and finally lifting the cantilever beams with the truck crane to a flatbed truck for removal;

(2) removing the lateral pier support systems 34 and loading same onto a truck: as shown in FIG. 3 and FIG. 4*b*, near two ends of a main beam section b in the length extension direction, lifting a side close to each lateral pier support system 34 by using first hoisting equipment 5, hoisting a side close to a main pier support system 2 by using second hoisting equipment 4, and then removing connections between the main beam section b and lateral pier vertical supports, so that the lateral pier vertical supports can be hoisted onto a flatbed truck by using a truck crane;

(3) removing the main beam section b connected to the lateral pier support systems 34 and loading same onto a truck:

as shown in FIG. 3 and FIG. 4*c*, after the lateral pier vertical support is removed and a connection between the main beam section b and the main beam section a is removed, simultaneously starting the first hoisting equipment 5 and the second hoisting equipment 4 used in step (2), lowering the main beam section b to the ground, then pulling the main beam section outside the projection area of a pre-fabricated small box girder 15 by using a truck crane, and hoisting the main beam section onto a flatbed truck;

(4) removing, horizontally displacing, and lowering the main beam section a connected to the main pier support system 2:

as shown in FIG. 3 and FIG. 4*d*, after the main beam section a is lifted by using movable hoisting equipment, removing a link between the main beam section a and the main truss system, next, as shown in FIG. 4*e*, starting a horizontal-displacement apparatus of the movable hoisting equipment, transporting the main beam section a near a midspan, then starting a lifting mechanism of the movable hoisting equipment, and lowering the main beam section a onto a flatbed truck;

(5) hoisting, lowering, and laying flat the main truss system and loading same onto a truck: as shown in FIG. 3 and FIG. 4*f*, starting the horizontal-displacement apparatus of the movable hoisting equipment, and enabling the movable hoisting equipment to reset; and hoisting the main truss system, and then removing a constraint between the main truss system and a main pier vertical support;

as shown in FIG. 3 and FIG. 4*g*, starting the horizontal-displacement apparatus, transporting the main truss system near the midspan, and finally lowering and laying flat the main truss system by using the lifting mechanism of the movable hoisting equipment;

as shown in FIG. 3 and FIG. 4*h*, replacing a connecting position between the lifting mechanism in displaceable hoisting equipment and the main truss system, until the displaceable hoisting equipment can move the main truss system in a lying state to a flatbed truck; and (6) removing the main pier vertical support system and a pad beam:

as shown in FIG. 3 and FIG. 4*i*, starting the horizontal-displacement apparatus, restoring the movable hoisting equipment at a section of the pre-fabricated small box girder 15 above the original support, hoisting the main pier vertical support system, and then removing a link between the main pier vertical support system and the pad beam; and then starting the horizontal-displacement apparatus to move the main pier vertical support system near the midspan, and finally starting an electric hoist to move the main pier vertical support system to a flatbed truck.

What is claimed is:

1. A method for removal of a temporary support system for a road bridge pre-fabricated small box girder-type concealed bent cap, the method comprising following steps:

(1) removing cantilever beams:

first lifting the cantilever beams with a truck crane, then removing connections between the cantilever beams and a main beam, and finally lifting the cantilever beams with the truck crane to a flatbed truck for removal;

(2) removing a lateral pier support system and loading same onto a truck:

near two ends of an outer-side main beam section in a length extension direction, lifting a side close to the lateral pier support system by using a first hoisting equipment, hoisting a side close to a main pier support system by using a second hoisting equipment, and then removing connections between the outer-side main beam section and a lateral pier vertical support, so that the lateral pier vertical support can be hoisted onto a flatbed truck by using a truck crane;

(3) removing the outer-side main beam section connected to the lateral pier support system and loading same onto a truck:

after the lateral pier vertical support is removed and a connection between the outer-side main beam section and a main beam middle section is removed, simultaneously starting the first hoisting equipment and the second hoisting equipment used in step (2), lowering the outer-side main beam section to the ground, then pulling the outer-side main beam section outside a projection area of a pre-fabricated small box girder by using a truck crane, and hoisting the outer-side main beam section onto a flatbed truck;

(4) removing, horizontally displacing, and lowering the main beam middle section connected to the main pier support system:

after the main beam middle section is lifted by using a movable hoisting equipment, removing a link between the main beam middle section and a main truss system, then starting a horizontal-displacement apparatus of the movable hoisting equipment, transporting a main beam section a near a midspan, then starting a lifting mechanism of the movable hoisting equipment, and lowering the main beam middle section onto a flatbed truck;

(5) hoisting, lowering, and laying flat the main truss system and loading same onto a truck:

starting the horizontal-displacement apparatus of the movable hoisting equipment, and enabling the movable hoisting equipment to reset; and hoisting the main truss system, and then removing a constraint between the main truss system and a main pier vertical support;

starting the horizontal-displacement apparatus, transporting the main truss system near the midspan, and finally lowering and laying flat the main truss system by using the lifting mechanism of the movable hoisting equipment;

replacing a connecting position between the lifting mechanism in the movable hoisting equipment and the main truss system, until the movable hoisting equipment can move the main truss system in a lying state to a flatbed truck; and (6) removing the main pier vertical support system and a pad beam:

starting the horizontal-displacement apparatus, restoring the movable hoisting equipment at a section of the pre-fabricated small box girder above the original support, hoisting the main pier vertical support system, and then removing a link between the main pier vertical support system and the pad beam; and then starting the horizontal-displacement apparatus to move the main pier vertical support system near the midspan, and finally starting an electric hoist to move the main pier vertical support system to a flatbed truck.

2. The removal method according to claim 1, wherein the first hoisting equipment used in step (2) comprises a cantilever crossbeam, a counter-pressure crossbeam, a first lifting mechanism, and an anchored pier head;

the cantilever crossbeam can be disposed spanning a width of the concealed bent cap;

at least one counter-pressure crossbeam is disposed on an upper surface of the cantilever crossbeam;

the first lifting mechanism is fixed below the cantilever crossbeam; and the anchored pier head is arranged at the top of the counter-pressure crossbeam, an anchor bolt of the anchored pier head is fixed to the cast-in-place concealed bent cap, and the cantilever crossbeam is tightly pressed between the counter-pressure crossbeam and the cast-in-place concealed bent cap through anchoring of the cast-in-place concealed bent cap by the anchored pier head fixed on the counter-pressure crossbeam.

3. The removal method according to claim 1, wherein the second hoisting equipment used in step (2) comprises a supporting crossbeam, a foundation beam, and a second lifting mechanism; and the foundation beam comprises a foundation beam a and a foundation beam b;

the supporting crossbeam spans above two adjacent pre-fabricated small box girders; and one end of the supporting crossbeam is fixed to the cast-in-place concealed bent cap by the foundation beam a, whereas the other end is fixed to a top pad beam arranged on the pre-fabricated small box girder by the foundation beam b; and the second lifting mechanism is supported in a lifted manner on the supporting crossbeam, and a lifting end of the second lifting mechanism can pass through a gap between two adjacent pre-fabricated small box girders to be fixed to a side, close to the main pier support system, of the outer-side main beam section.

4. The removal method according to claim 1, wherein the movable hoisting equipment used in step (4) comprises the horizontal-displacement apparatus, the lifting mechanism, and a moving cart that can be driven by the power of the horizontal-displacement apparatus to carry the lifting mechanism to reciprocate along a movable track;

the lifting mechanism is assembled on the moving cart, and a lifting end of the lifting mechanism can pass through a gap between two adjacent pre-fabricated small box girders to be fixed to the main beam middle section;

the movable track is paved in a longitudinal direction; and the horizontal-displacement apparatus comprises a power mechanism, and an output end of the power mechanism is fixed to the moving cart by a traction steel wire rope; and the power mechanism is arranged in the area of the cast-in-place concealed bent cap by a counterforce bracket.

5. The removal method according to claim 4, wherein the moving cart comprises a support crossbeam and a foundation crossbeam; an upper end of the foundation crossbeam is fixed to the support crossbeam, whereas a lower end is provided with a roller wheel movable along the movable track; and the lifting mechanism is assembled on a support crossbeam.

6. The removal method according to claim 4, wherein two horizontal-displacement apparatuses, two moving carts, and two movable tracks are symmetrically distributed on two sides of a centerline of a road in a transverse direction.

7. The removal method according to claim 6, wherein a power source of the horizontal-displacement apparatus is a continuous jack, and the continuous jack is fixed to the area of the cast-in-place concealed bent cap by a counterforce frame.

8. The removal method according to claim 7, wherein a bottom of the counterforce frame is anchored in the concealed bent cap, whereas a manual hoist used for hoisting the continuous jack is disposed at the top.

* * * * *